US011527830B2

(12) United States Patent
Doumanis et al.

(10) Patent No.: US 11,527,830 B2
(45) Date of Patent: Dec. 13, 2022

(54) ANTENNA SYSTEM WITH RADIATOR EXTENSIONS

(71) Applicant: NOKIA SOLUTIONS AND NETWORKS OY, Espoo (FI)

(72) Inventors: Efstratios Doumanis, Helsinki (FI); Murat Emre Ermutlu, Helsinki (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 17/158,135

(22) Filed: Jan. 26, 2021

(65) Prior Publication Data

US 2021/0234271 A1 Jul. 29, 2021

(30) Foreign Application Priority Data

Jan. 28, 2020 (EP) ..... 20153977

(51) Int. Cl.
*H01Q 9/04* (2006.01)
*H01Q 1/48* (2006.01)

(52) U.S. Cl.
CPC ..... *H01Q 9/0457* (2013.01); *H01Q 1/48* (2013.01)

(58) Field of Classification Search
CPC ..... H01Q 9/0457; H01Q 1/48
See application file for complete search history.

(56) References Cited

U.S. PATENT DOCUMENTS 4,763,130 A * 8/1988 Weinstein ..... H01Q 13/12 343/768
4,924,236 A * 5/1990 Schuss ..... H01Q 9/0442 343/859
6,870,514 B2 * 3/2005 Simpson ..... H01Q 9/36 343/846
7,710,324 B2 * 5/2010 Tatarnikov ..... H01Q 9/0407 343/700 MS
8,077,092 B2 * 12/2011 Coupez ..... H01Q 1/38 343/846
8,405,555 B2 * 3/2013 Liu ..... H01Q 9/40 343/702
8,446,322 B2 * 5/2013 Tatarnikov ..... H01Q 9/0428 343/702
9,172,144 B2 * 10/2015 Tatarnikov ..... H01Q 9/0471
9,647,328 B2 * 5/2017 Dobric ..... H01Q 1/38
9,673,526 B1 * 6/2017 Jensen ..... H01Q 9/0414
(Continued)

FOREIGN PATENT DOCUMENTS

CN 101038983 A 9/2007
KR 101 974 546 B1 5/2019

OTHER PUBLICATIONS

Extended European Search Report for EP Application No. 20153977.2 dated Jul. 21, 2020, 14 pages.
(Continued)

*Primary Examiner* — Ab Salam Alkassim, Jr.
(74) *Attorney, Agent, or Firm* — Alston & Bird LLP

(57) ABSTRACT

An antenna system including a ground plane, an antenna radiator separated from and overlapping the ground plane and at least one first conductive element extending the antenna radiator towards the ground plane. The antenna system also includes at least one feed element configured to provide a radio-frequency feed for the antenna radiator. The feed element is spatially separated from the first conductive element and the antenna radiator.

20 Claims, 9 Drawing Sheets

(56) References Cited

U.S. PATENT DOCUMENTS

2002/0014995 A1 2/2002 Roberts
2004/0160380 A1* 8/2004 Simpson ..... H01Q 1/242 343/850
2004/0233119 A1 11/2004 Chandler
2007/0268188 A1* 11/2007 Guha ..... H01Q 9/0414 343/700 MS
2008/0042915 A1* 2/2008 Schillmeier ..... H01Q 9/0457 343/745
2008/0198086 A1* 8/2008 Coupez ..... H01Q 1/38 343/824
2009/0140930 A1* 6/2009 Tatarnikov ..... H01Q 9/0428 343/700 MS
2012/0068898 A1* 3/2012 Clow ..... H01Q 9/36 343/893
2012/0068902 A1* 3/2012 Clow ..... H01Q 5/50 343/791
2013/0187726 A1 7/2013 Apostolos et al.
2013/0249751 A1 9/2013 Legare
2014/0009349 A1* 1/2014 Tatarnikov ..... H01Q 9/0471 343/749
2019/0198998 A1* 6/2019 Chiu ..... H04B 7/10
2019/0312329 A1* 10/2019 Karhu ..... H01P 7/04
2020/0083590 A1* 3/2020 Doumanis ..... H01P 1/2053
2021/0044018 A1* 2/2021 Takaki ..... H01Q 5/35
2021/0288409 A1* 9/2021 Delaveaud ..... H01Q 1/48
2022/0077594 A1* 3/2022 Gamalski ..... H01Q 9/0457

OTHER PUBLICATIONS

Wincza et al., "Broadband Multibeam Antenna Arrays Fed by Frequencydependent Butler Matrices", IEEE Transactions on Antennas and Propagation, vol. 65, No. 9, (Sep. 2017) pp. 4539-4547.

* cited by examiner

ANTENNA SYSTEM WITH RADIATOR EXTENSIONS

CROSS-REFERENCE TO RELATED APPLICATION

This application claims priority to European Application No. 20153977.2, filed Jan. 28, 2020, the entire contents of which are incorporated herein by reference.

TECHNOLOGICAL FIELD

Embodiments of the present disclosure relate to an antenna system, a feed system and an antenna.

BACKGROUND

In a mobile cellular telecommunication network, a base station transceiver (or user equipment transceiver) normally comprises transceiver circuitry interconnected to an antenna radiator via a high-quality filter. The high-quality filters can be quite large.

If the base station transceiver (or user equipment transceiver) has a large number of antenna radiators then a correspondingly large number of filters are required. This can occupy a large volume.

BRIEF SUMMARY

According to various, but not necessarily all, embodiments there is provided an antenna system comprising:

a ground plane;

an antenna radiator separated from and overlapping the ground plane;

at least one first conductive element extending the antenna radiator towards the ground plane; and at least one feed element configured to provide a radio-frequency feed for the antenna radiator, wherein the feed element is spatially separated from the first conductive element and the antenna radiator.

In some, but not necessarily all examples, the feed element extends substantially parallel to the first conductive element.

In some, but not necessarily all examples, the first conductive element circumscribes the feed element.

In some, but not necessarily all examples, the first conductive element extends towards the ground plane and has an axis of rotational symmetry that extends towards the ground plane and the feed element extends towards the antenna radiator along an axis of rotational symmetry that extends towards the antenna radiator, wherein the first conductive element and the feed element are substantially coaxial.

In some, but not necessarily all examples, the first conductive element is shaped substantially as a hollow cylinder.

In some, but not necessarily all examples, the antenna system further comprises at least one second conductive element extending the ground plane towards the antenna radiator, wherein the second conductive element is spatially separated from the first conductive element.

In some, but not necessarily all examples, the feed element extends towards the antenna radiator in a direction substantially parallel to a direction in which the first conductive element extends the antenna radiator and substantially parallel to a direction in which a second conductive element extends the ground plane.

In some, but not necessarily all examples, the first conductive element circumscribes a first portion of a length of the feed element and the second conductive element circumscribes a different, second portion of the length of the feed element.

In some, but not necessarily all examples, the first conductive element extends towards the ground plane and has an axis of rotational symmetry that extends towards the ground plane, the second conductive element extends towards the antenna radiator and has an axis of rotational symmetry that extends towards the antenna radiator, and the feed element extends towards the antenna radiator along an axis of rotational symmetry that extends towards the antenna radiator, wherein the axes of the first conductive element, the second conductive element and the feed element are coaxial.

In some, but not necessarily all examples, the first conductive element is shaped substantially as a hollow cylinder having a first diameter and the second conductive element is shaped substantially as a hollow cylinder having a second, different diameter.

In some, but not necessarily all examples, the first conductive element is closer to the feed element than the second conductive element.

In some, but not necessarily all examples, the feed element is an open-ended feed configured to contactlessly feed the antenna radiator.

In some, but not necessarily all examples, the antenna radiator is a patch antenna.

In some, but not necessarily all examples, the feed element, the first conductive element, and, if present, the second conductive element, are configured to provide a narrowband resonant frequency feed for the antenna radiator, wherein a narrowband resonant frequency of the feed is dependent upon location and dimensions of the feed element, the first conductive element and, if present, the second conductive element.

In some, but not necessarily all examples, at least one of the dimensions of one or more of the first conductive element, the feed element and, if present, the second conductive element are variable to tune the narrowband resonant frequency of the narrowband resonant frequency feed.

In some, but not necessarily all examples, the first conductive element is positioned closer to an edge of the radiator than a center of the radiator.

In some, but not necessarily all examples, the first conductive element extends the antenna radiator towards the ground plane at a first location and the feed element is configured to provide a radio frequency feed, at the first location, for the antenna radiator, the antenna system further comprising:

- a further first conductive element extending, at a second location, the antenna radiator towards the ground plane; and
- a further feed element configured to provide a further radio frequency feed, at the second location, for the antenna radiator, wherein the further feed element is spatially separated from the further first conductive element and the antenna radiator, wherein the first conductive element and the feed element provide a first narrowband resonant frequency feed at the first location and wherein the further first conductive element and the further feed element provide a second narrowband resonant frequency feed at the second location.

In some, but not necessarily all examples, the first narrowband resonant frequency feed and the second narrowband resonant frequency feed are configured to have different narrowband resonant frequencies or wherein the first narrowband resonant frequency feed and the second narrowband resonant frequency feed are configured to have the same resonant frequency but are located for orthogonal polarization.

In some, but not necessarily all examples, a network access node or a portable electronic device comprises one or more antenna systems.

According to various, but not necessarily all, embodiments there is provided a narrowband resonant frequency feed system for an antenna radiator comprising:

a ground plane;

a feed element extending in a first direction from the ground plane to provide a radio frequency feed for the antenna radiator;

a conductive element extending in the first direction from the ground plane and at least partially circumscribing the feed element; wherein the feed element is spatially separated from the conductive element and the conductive element is galvanically connected to the ground plane.

According to various, but not necessarily all, embodiments there is provided an antenna for use with the narrowband resonant frequency system comprising:

an antenna radiator;

a conductive element extending the antenna radiator that is at least partially circumscribes the feed element and is at least partially circumscribed by the conductive element of the narrowband resonant frequency feed system.

According to various, but not necessarily all, embodiments there is provided examples as claimed in the appended claims.

BRIEF DESCRIPTION

Some examples will now be described with reference to the accompanying drawings in which.

DETAILED DESCRIPTION

Figure 1:
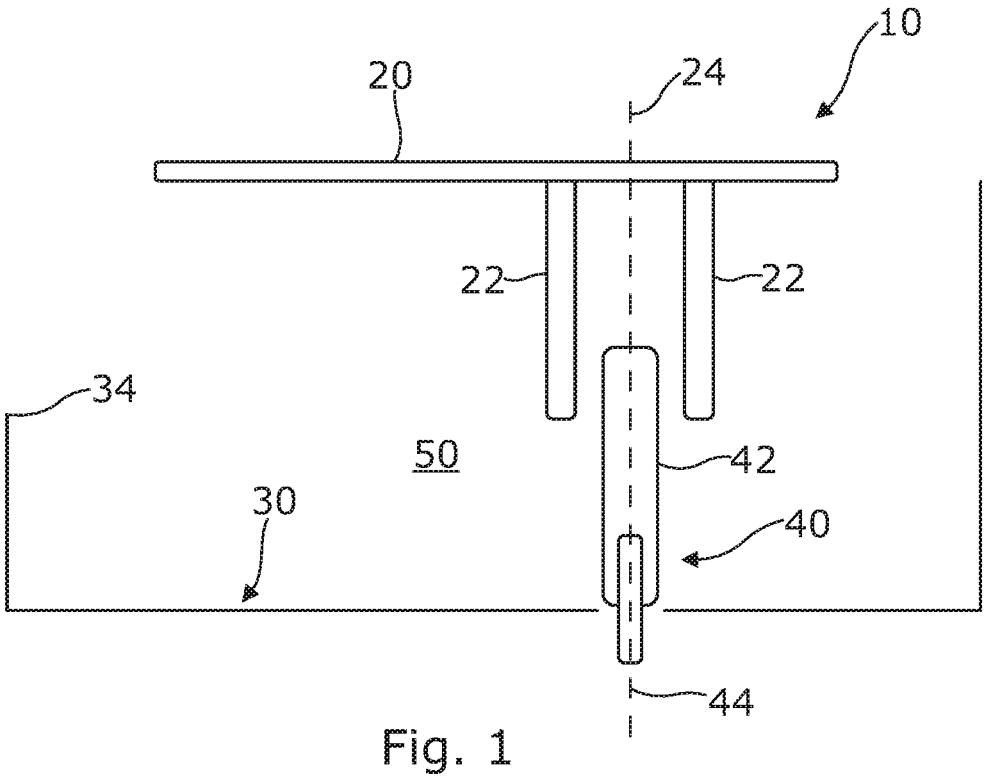
FIG. 1 shows an example of the subject matter described herein.

FIG. 1 illustrates an example of an antenna system 10. The antenna system 10 comprises a ground plane 30, an antenna radiator 20, a first conductive element 22 and a feed element 42.

The antenna radiator 20 is separated from and fully or partially overlaps the ground plane 30. The first conductive element 22 extends the antenna radiator 20 towards the ground plane 30. The feed element 42 is configured to provide a radio frequency feed for the antenna radiator 20. The feed element 42 is spatially separated from the first conductive element 22 and the antenna radiator 20.

In this example, but not necessarily all examples, the antenna radiator 20 is substantially planar. In this example, but not necessarily all examples, the ground plane 30 is substantially planar. In other examples, the antenna radiator 20 and/or the ground plane 30 can be any shape and can, for example, be wholly or partially planar and/or wholly or partially non-planar and/or curved. In some examples the antenna radiator 20 and the ground plane 30 both having planar and non-planar portions.

The first conductive element 22 extends the antenna radiator 20 in the sense that there is a galvanic current path (direct current path) from the antenna radiator 20 to the first conductive element 22. The first conductive element 22 may be an integral part of the antenna radiator 20 or may be attached to the antenna radiator 20.

The feed element 42 is proximal to the first conductive element 22 and the feed element 42 is capacitively coupled to the first conductive element 22. The feed element 42 is therefore coupled to the antenna radiator 20 via the first conductive element 22.

In this example, the feed element 42 extends towards the antenna radiator 20 in a direction substantially parallel to a direction in which the first conductive element 22 extends the antenna radiator 20. The feed element 42, in this example (but not necessarily all examples) is elongate and is substantially longer than it is wide. The feed element 42 extends in the lengthwise direction towards the antenna radiator 20 in the direction substantially parallel to the direction in which the first conductive element 42 extends the antenna radiator 20. The feed element 42 is proximal to the first conductive element 22, in this example, in the sense that it is significantly closer than the length of the feed element and, in this example, but not necessarily all examples, is closer than the lateral dimension of the feed element 42.

In this example, but not necessarily all examples, the first conductive element 22 circumscribes at least a portion of the feed element 42. In this sense, circumscribes means that the feed element 42 is surrounded on four sides by the first conductive element 22. The term circumscribes does not necessarily imply a circular cross section for the first conductive element 22.

In the example illustrated, the first conductive element 22 extends towards the ground plane 30 and has an axis 24 of rotational symmetry that extends towards the ground plane 30. The feed element 42 extends towards the antenna radiator 20 along an axis 44. The axis 24 and the axis 44 are parallel. In the particular example illustrated, the feed element 42 extends towards the antenna radiator 20 along an axis 44 of rotational symmetry that extends towards the antenna radiator 20 and the axis 24 and the axis 44 are aligned. The first conductive element 22 and the feed element 42 are consequentially substantially coaxial.

In some, but not necessarily all examples, the first conductive element 22 is shaped substantially as a hollow cylinder. However, other shapes are possible, and not limited to, such as shapes that have a square or rectangular cross section. Furthermore, the cross section of the first conductive element does not need to have a constant area and can for example taper inwards, or outwards or otherwise vary as it extends from the antenna radiator 20 towards the ground plane 30.

It will be appreciated by referring to FIG. 1, that an antenna radiator 20 has a physical and galvanic connection with the first conductive element 22. The first conductive element 22 consequently extends the antenna radiator 20. The antenna radiator 20 is spatially separated from the ground plane 30 and there is no galvanic connection between the antenna radiator 20 and the ground plane 30. The antenna radiator 20 is spatially separated from the feed element 42 and there is no galvanic connection between the antenna radiator 20 and the feed element 42.

The first conductive element 22 is spatially separated from the ground plane 30 and there is no galvanic connection between the first conductive element 22 and the ground plane 30. The first conductive element 22 is spatially separated from the feed element 42 and there is no galvanic connection between the first conductive element 22 and the feed element 42. The spatial separation between the first conductive element 22 and the feed element 42 is small and there is capacitive coupling between the first conductive element 22 and the feed element 42.

The ground plane 30 is spatially separated from the feed element 42 and there is no galvanic connect between the ground plane 30 and feed element 42.

Figure 2:
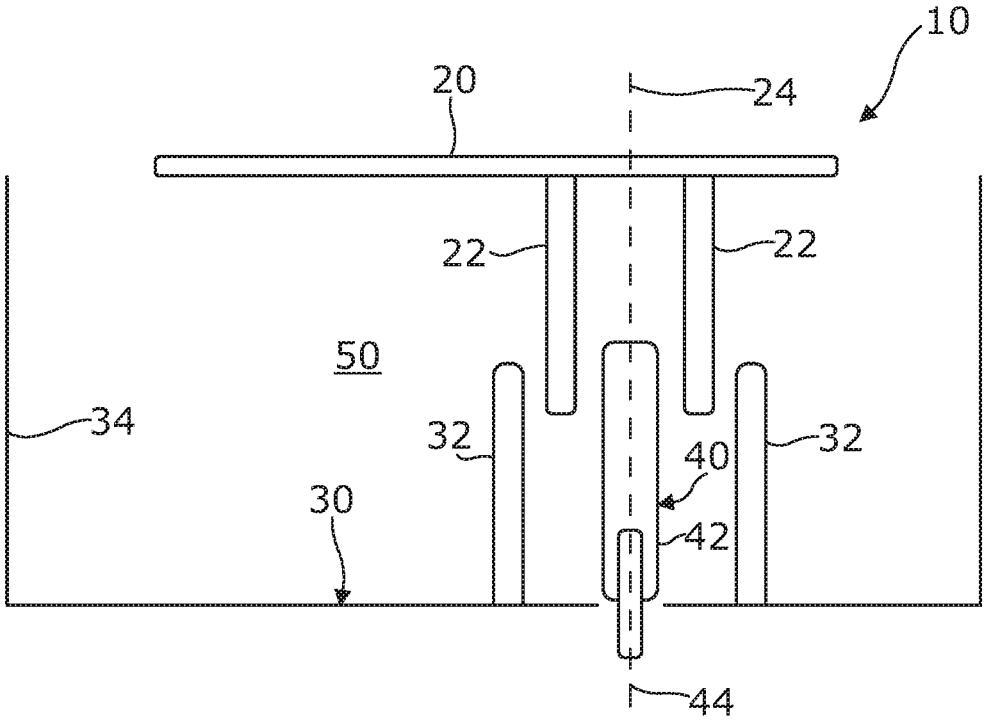
FIG. 2 shows another example of the subject matter described herein.

FIG. 2 illustrates an example of the antenna system 10 previously described with reference to FIG. 1. In this example, the antenna system 10 further comprises a second conductive element 32 extending the ground plane 30 towards the antenna radiator 20 to capacitively couple with the first conductive element 22. The second conductive element 32 is spatially separated from the first conductive element 22.

The second conductive element 32 extends the ground plane 30 in the sense that there is a direct current path between the ground plane 30 and the second conductive element 32. The second conductive element 32 may be an integral part of the ground plane 30 or may be attached to the ground plane 30.

The second conductive element 32 is proximal to the first conductive element 22 in the illustrated example. This enables good capacitive coupling between the first conductive element 22 and the second conductive element 32.

In this example, the feed element 42 extends towards the antenna radiator 20 in a direction substantially parallel to a direction in which the first conductive element 22 extends the antenna radiator 20 and substantially parallel to a direction in which the second conductive element 32 extends the ground plane 30. The feed element 42, in this example (but not necessarily all examples) is elongate and is substantially longer than it is wide. The feed element 42 extends in the lengthwise direction towards the antenna radiator 20 in the direction substantially parallel to the direction in which the first conductive element 22 extends the antenna radiator 20 and substantially parallel to a direction in which the second conductive element 32 extends the ground plane 30. The feed element 42 is proximal to the first conductive element 22, in this example, in the sense that it is significantly closer than the length of the feed element and, in this example, but not necessarily all examples, is closer than the lateral dimension of the feed element 42.

The second conductive element 32 is proximal to the first conductive element 22, in this example, in the sense that it is significantly closer than the length of the feed element 42 and, in this example, but not necessarily all examples, is closer than the lateral dimension of the feed element 42.

In this example, but not necessarily all examples, the first conductive element 22 circumscribes a first portion of a length of the feed element 42 and the second conductive element 32 circumscribes a different, second portion of the length of the feed element 42. In this sense, circumscribes means that the feed element 42 is surrounded on four sides by a respective conductive element 22, 32. The term circumscribes does not necessarily imply a circular cross section for the respective conductive element 22, 32.

In this example, but not necessarily all examples, the first conductive element 22 and the second conductive element 32 overlap, and a portion of the length of the feed element 42 is circumscribed by both the first conductive element 22 and the second conductive element 32. In this sense, circumscribes means that the portion of the feed element 42 is surrounded on four sides by respective conductive elements 22, 32. The term circumscribes does not necessarily imply a circular cross section for the respective conductive elements 22, 32.

In the example illustrated, the first conductive element 22 extends towards the ground plane 30 and has an axis 24 of rotational symmetry that extends towards the ground plane 30. The second conductive element 32 extends towards the antenna radiator 20 and has an axis 44 of rotational symmetry that extends towards the antenna radiator 20. The feed element 42 extends towards the antenna radiator 20 along an axis 44. The axes are parallel. In the particular example illustrated, the feed element 42 extends towards the antenna radiator 20 along an axis 44 of rotational symmetry that extends towards the antenna radiator 20 and the axes are aligned. The first conductive element 22, the second conductive element 32 and the feed element 42 are consequentially substantially coaxial.

In some, but not necessarily all examples, the first conductive element 22 is shaped substantially as a hollow cylinder that has a first diameter $d_1$. However, other shapes are possible, and not limited to, such as shapes that have a square or rectangular cross section. Furthermore, the cross section of the first conductive element 22 does not need to have a constant area and can for example taper inwards, or outwards or otherwise vary as it extends from the antenna radiator 20 towards the ground plane 30.

In some, but not necessarily all examples, the second conductive element 32 is shaped substantially as a hollow cylinder that has a second diameter $d_2$. However, other shapes are possible, and not limited to, such as shapes that have a square or rectangular cross section. Furthermore, the cross section of the second conductive element 32 does not need to have a constant area and can for example taper inwards, or outwards or otherwise vary as it extends from the ground plane 30 towards the antenna radiator 20.

In this example, the first and second conductive elements 22, 32 are cylinders and the second diameter $d_2$ is greater than the first diameter $d_1$.

Dielectric material or materials or combinations of an air and dielectric filling can fill some or all of the space inside a perimeter of a conductive element 22, 32, including the space between conductive elements 22, 32 and between the feed element 42 and the conductive elements 22, 32.

It will be appreciated by referring to FIG. 2, that an antenna radiator 20 has a physical and galvanic connection (direct current connection) with the first conductive element 22. The first conductive element 22 consequently extends the antenna radiator 20. The antenna radiator 20 is spatially separated from the ground plane 30 and there is no galvanic connection between the antenna radiator 20 and the ground plane 30. The antenna radiator 20 is spatially separated from the second conductive element 32 and there is no galvanic connection between the antenna radiator 20 and the second conductive element 32. The antenna radiator 20 is spatially separated from the feed element 42 and there is no galvanic connection between the antenna radiator 20 and the feed element 42.

The first conductive element 22 is spatially separated from the ground plane 30 and there is no galvanic connection between the first conductive element 20 and the ground plane 30. The first conductive element 22 is spatially separated from the second conductive element 32 and there is no galvanic connection between the first conductive element 22 and the second conductive element 32. The spatial separation between the first conductive element 22 and the second conductive element 32 is small and there is capacitive coupling between the first conductive element 22 and the second conductive element 32. The first conductive element 22 is spatially separated from the feed element 42 and there is no galvanic connection between the first conductive element 22 and the feed element 42. The spatial separation between the first conductive element 22 and the feed element 42 is small and there is capacitive coupling between the first conductive element 22 and the feed element 42.

The ground plane 30 has a physical and galvanic connection with the second conductive element 32. The second conductive element 32 consequently extends the ground pane 30. The ground plane 30 is spatially separated from the feed element 42 and there is no galvanic connection between the ground plane 30 and feed element 42.

In this example, but not necessarily all examples, the second conductive element 32 is spatially separated from the feed element 42 and there is no galvanic connection between the ground plane 30 and feed element 42.

Figure 3A:
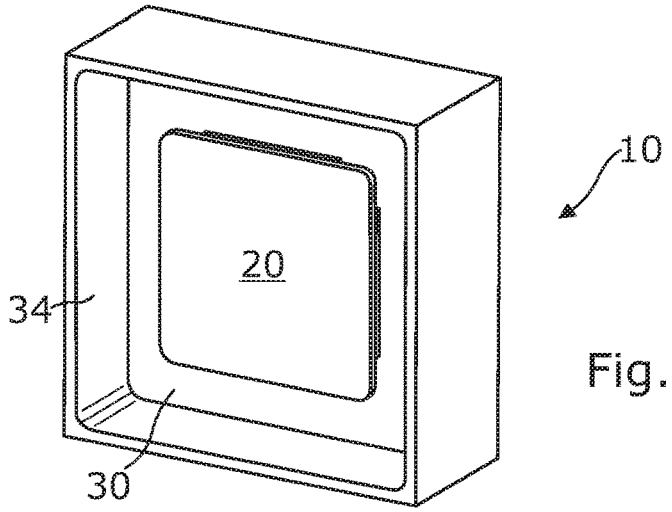
FIGS. 3A and 3B show another example of the subject matter described herein.
Figure 3B:
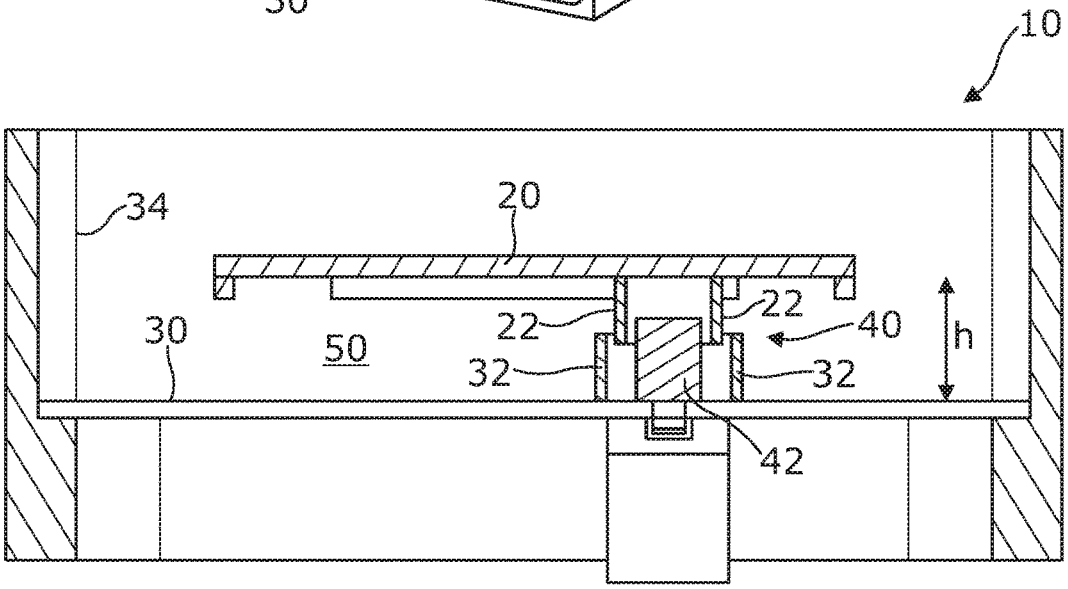

FIG. 3A illustrates a perspective view of an example of the antenna system 10 illustrated in FIG. 2 and FIG. 3B illustrates a cross section through the feed element 42, the first conductive element 22, the second conductive element 32, the antenna radiator 20 and the ground plane 30 of the antenna system 10 illustrated in FIG. 3A.

In this example, the first conductive element 22 is a hollow cylinder and the second conductive element 32 is a hollow cylinder. The diameter $d_1$ of the cylindrical first conductive element 22 is, in this example, smaller than the diameter $d_2$ of the cylindrical second conductive element 32. The cylindrical first conductive element 22 and the cylindrical second conductive element 32 are coaxial and they share the same axis with the feed element 42, as previously described. In this example, the cylindrical first conductive element 22 and the cylindrical second conductive element 32 overlap. The cylindrical first conductive element 22 is partially inserted inside the cylindrical second conductive element 32. As a consequence the first conductive element 22 is closer to the feed element 42 than the second conductive element 32. It may, in some examples be possible to have an arrangement in which the second conductive element 32 is closer to the feed element 42 than the first conductive element 22. In such an example, the diameter $d_1$ of the cylindrical first conductive element 22 is larger than the diameter $d_2$ of the cylindrical second conductive element 32.

The ground plane 30 extends substantially in a first physical plane and the antenna radiator 20 extends substantially in a second physical plane parallel to the first physical plane. The first conductive element 22 extends substantially perpendicular to the first and second physical planes. The second conductive element 32 extends substantially perpendicular to the first and second physical planes. The feed element 42 extends substantially perpendicular to the first and second physical planes.

Figure 3C:
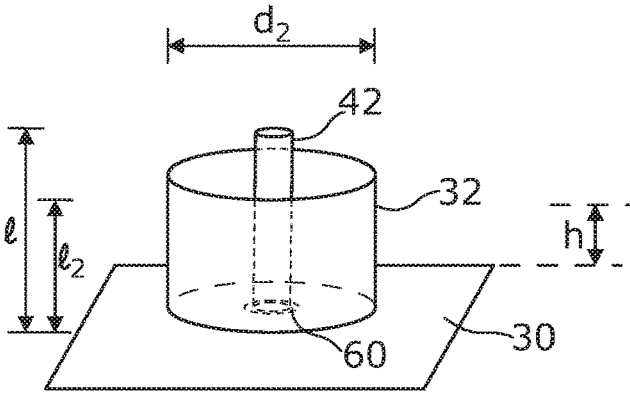
FIG. 3C shows another example of the subject matter described herein.
Figure 3D:
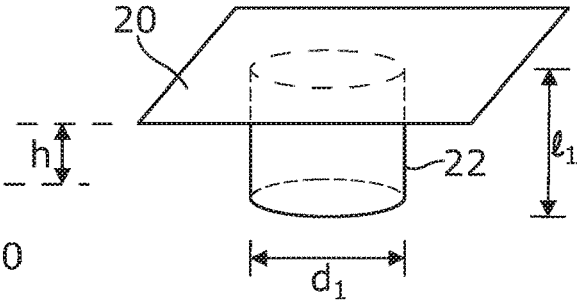
FIG. 3D shows another example of the subject matter described herein.

FIG. 3C and FIG. 3D illustrate component parts of the antenna system 10 illustrated in FIG. 3B. FIG. 3C illustrates the ground plane 30 and the cylindrical second conductive element 32 that extend the ground plane 30 towards the antenna radiator 20. It also illustrates the feed element 42 extending through, but not contacting, the ground plane 30 towards the antenna radiator 20. In this example, the feed element 42 has a substantially cylindrical shape and the axis of the cylindrical feed element 42 and the axis of the cylindrical second conductive element 32 are aligned. FIG. 3D illustrates a portion of the antenna radiator 20 and also the cylindrical first conductive element 22 that extends the antenna radiator 20 towards the ground plane 30. In these examples, the cylindrical first conductive element 22 has a diameter $d_1$ and the cylindrical second conductive element 32 as a diameter of $d_2$. In this example the diameter $d_1$ is less than the diameter $d_2$. In these examples, the cylindrical first conductive element 22 has a length $l_1$ and the cylindrical second conductive element 32 has a length $l_2$. When the antenna system 20 is assembled, the antenna radiator 20 is separated from the ground plane 30 by a distance h where h is less than the sum of $l_1$ and $l_2$. Consequently, the cylindrical first conductive element 22 and the cylindrical second conductive element 32 at least partially overlap. It can also be seen that in this example the length l of the feed element 42 above the ground plane 30 is greater than the length $l_2$ of the cylindrical second conductive element 32.

It will be appreciated that the antenna system 10 as described in FIGS. 1, 2, 3A and 3B is a volumetric antenna system that occupies a space 50. In the particular examples illustrated in FIGS. 1, 2 3A and 3B, the space 50 is an open cavity defined by the ground plane 30 and side walls 34. A cavity 50 is open in the sense that it does not fully enclose the feed element 42 and/or the antenna radiator 20. There are for example gaps between the antenna radiator 20 and the side walls 34.

Although side walls 34 are illustrated in these examples, they are entirely optional and in some examples they may be absent.

In the examples illustrated, the ground plane 30 is a conductive element of sufficient size that it can provide the function of a ground plane to the antenna system. As is known to those of ordinary skill in the art, a ground plane denotes a conductive element that provides a local ground or earth to a system. Although in the examples illustrated the ground plane is planar, the term "ground plane" should be understood in the functional rather than the physical sense. Therefore although in some examples the ground plane 30 is substantially physically planar in other examples it may not be.

In the examples illustrated, the ground plane 30 may be provided as a conductive layer of a printed circuit board (PCB) or as any other suitable conductor. For example, the ground plane 30 can be provided by a conductive/metal enclosure or box which is either milled from solid metal or manufactured from sheet metal materials and any seams filled with conductive material (solder or other options) to adjoin adjacent walls or parts of the sheet material.

In the examples illustrated, the feed element 42 is an open-ended feed 40 configured to contactlessly feed the antenna radiator 20. The feed element 42 does not have a galvanic connection (direct current connection) to the antenna radiator 20. It extends through an aperture 60 in the ground plane 30, without making a galvanic connection to the ground plane 30, towards the antenna radiator 20.

The radiator element 20 is, in the examples illustrated, a wideband radiator element. In the examples illustrated it is configured as a patch antenna but other antennas can be used. The radiator element 20, can in some examples be a narrowband radiator element. The radiator element 20 can be a different type of antenna, and examples include (without limitation) a PIFA (planar inverted-F antenna), a PILA (planar inverted-L antenna), a monopole, a dipole, a loop antenna, etc.

The preceding examples illustrate a radio frequency feed 40 for the radiator element 20 that comprises the feed element 42, the first conductive element 22 and, optionally, the second conductive element 32.

The combination of the first conductive element 22, the feed element 42 and, optionally, the conductive element 32 creates a narrowband resonant frequency feed 40 for the antenna radiator 20. A combination of the feed element 42, the first conductive element 22 and, optionally, the second conductive element 32, creates a resonant circuit (resonant feed) that feeds the antenna radiator 20. The characteristics of the resonant circuit are such that it has a narrowband resonant frequency and has the inherent properties of a filter. The antenna system 10 can, in some examples comprise an antenna 20 fed by the narrowband resonant circuit.

The antenna radiator 20 and the resonant feed operate two distinct resonant phenomena that overlap in frequency The resonant circuit has one or more resonant frequencies that are narrowband. The bandwidth of a resonant frequency is often described using a Q-factor. By controlling the dimensions of one or more of the feed element 42, the first conductive element 22 and, if present, the second conductive element 32, it is possible to tune both the Q-factor of the antenna system 10 and also the resonant frequency of the feed 40. It is therefore possible to control the narrowband nature of the feed 40 and also the resonant frequency of the feed 40.

If the resonant circuit defined by the feed element 42, the first conductive element 22 and, if present, the second conductive element 32, can be modelled as a complex RLC resonant circuit then the Q-factor can, in some circumstances be dependent upon $1/R*(L/C)^{1/2}$ and the resonant frequency as $(1/LC)^{1/2}$. By modifying and controlling the inductance L, the capacitance C and, optionally the resistance R it is possible to control the Q-factor and the resonant frequency of the feed 40.

The inductance L can for example be controlled by varying the length and/or diameter of the feed element 42, the first conductive element 22 and, if present, the second conductive element 32. If a conductor is made longer and thinner then it will generally have a higher inductance.

The capacitance C can for example be controlled by controlling the size of the gap between, the area of overlap between, the dielectric material between respective ones of the feed element 42, the first conductive element 22 and, if present, the second conductive element 32. Increasing the permittivity of the dielectric material, increasing the overlap and decreasing the gap will increase capacitance C.

In some, but not necessarily all examples of the antenna system 10, it may be desirable for the capacitance between feed element 42 and the first conductive element 22 to be of a similar order of magnitude or similar value to the capacitance between the first conductive element 22 and the second conductive element 32.

In some, but not necessarily all examples, the antenna system 10 may be configured so that any one or more of the dimensions of feed element 42, the first conductive element 22 and, if present, the second conductive element 32 can be varied to tune the bandwidth of a resonant frequency of the feed 40 and/or tune a resonant frequency of the feed 40 and also, as a consequence, of the antenna system 10.

It will therefore be appreciated that it is possible to have an antenna system 10 that has the same physical size but which operates at different frequencies and/or with different Q-factors. This therefore enables the combination of a wideband antenna radiator 20 with different narrowband resonant frequency feeds 40.

Figure 4A:
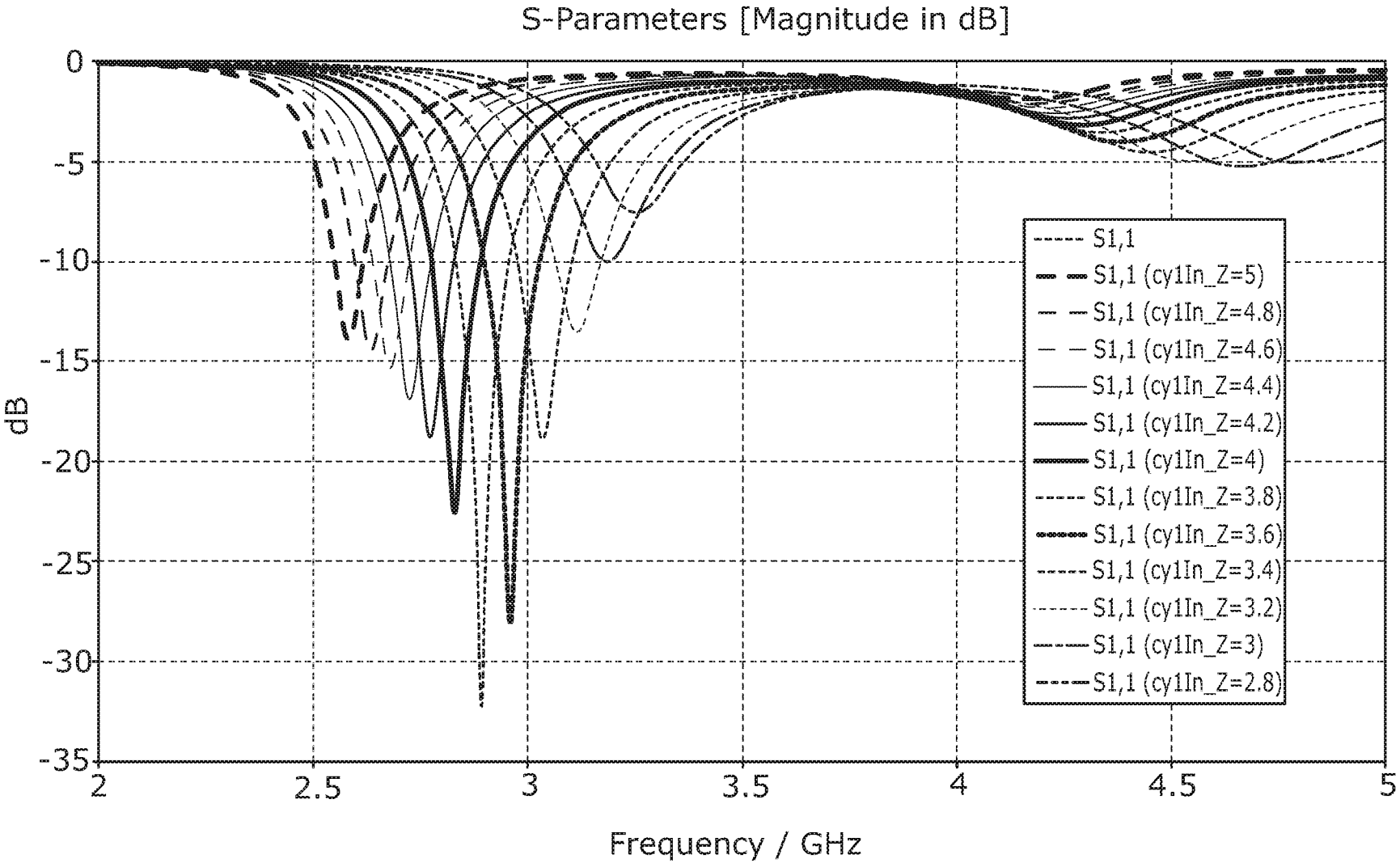
FIG. 4A, 4B, 4C show other examples of the subject matter described herein.
Figure 4B:
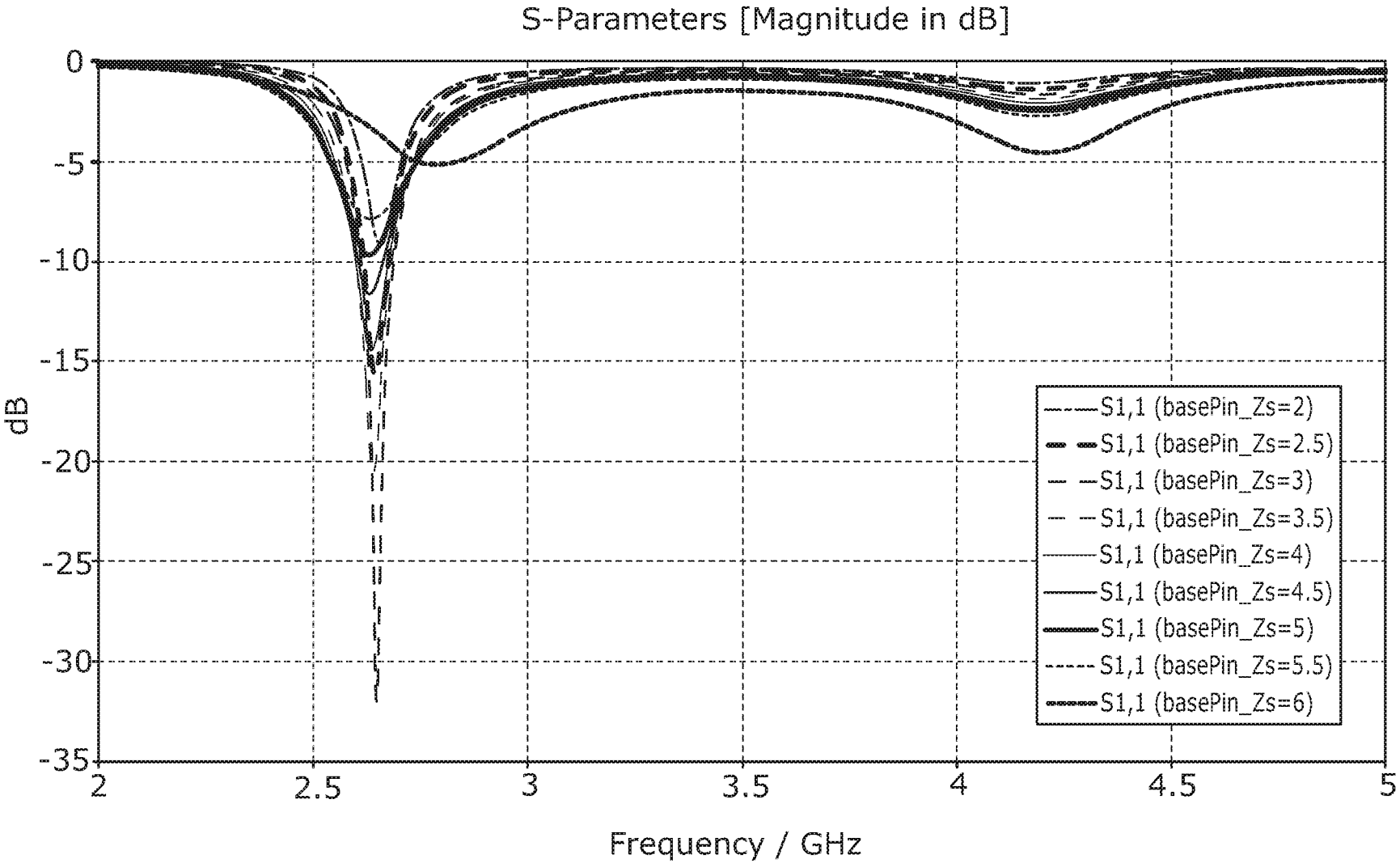
Figure 4C:
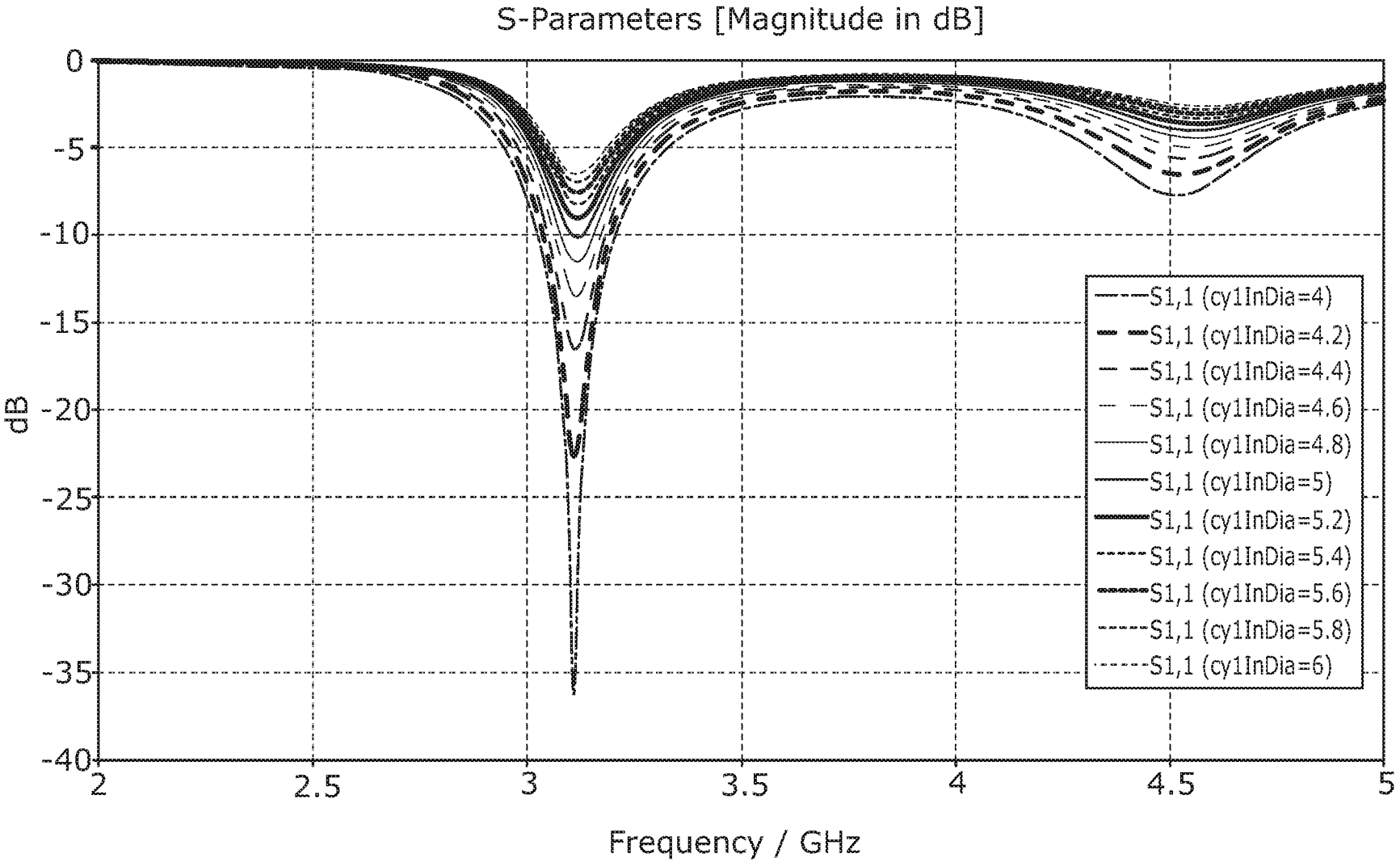

FIGS. 4A, 4B and 4C illustrate the effects of changing some of the dimensions of one or more of the first conductive element 22, the feed element 42 and, if present, the second conductive element 32.

In FIG. 4A, the length $l_2$ of the cylindrical second conductive element 32 is fixed and the length $l_1$ of the cylindrical first conductive element 22 is varied. Varying the length of the inner cylindrical first conductive element 22 will vary capacitance and inductance. It can be seen from the FIG. 4A that as the length $l_1$ of the cylindrical first conductive element 22 is increased the resonant frequency decreases.

FIG. 4B illustrates the effect of varying the length l of the feed element 42. When the length of the feed element is decreased, the Q-factor decreases causing a broadening of the resonant frequency band.

FIG. 4C illustrates the effect of changing the diameter $d_1$ of the cylindrical first conductive element 22 while simultaneously changing the diameter $d_2$ of the cylindrical second conductive element 32 so that the gap between the first and second elements 22, 32 remains a constant. It can be seen from the figure that increasing the diameter decreases the Q-factor. This can for example be explained by a decrease in inductance when increasing the diameter $d_1$.

It will therefore be appreciated that in at least some examples, there is provided a feed 40 for an antenna radiator 20 comprising: a ground plane 30;

a feed element 42 extending in a first direction from the ground plane 30 (e.g. optionally extending through an aperture 60 in the ground plane) and configured to provide a radio frequency feed 40 for the antenna radiator 20; a conductive element 32 extending in the first direction from the ground plane 30 and circumscribing at least a portion of a length of the feed element 42, wherein the feed element 42 is spatially separated from the conductive element 32 and the conductive element 32 is galvanically connected to the ground plane 20. The feed system 40 can, for example, be a narrowband resonant frequency feed as described above.

Figure 5:
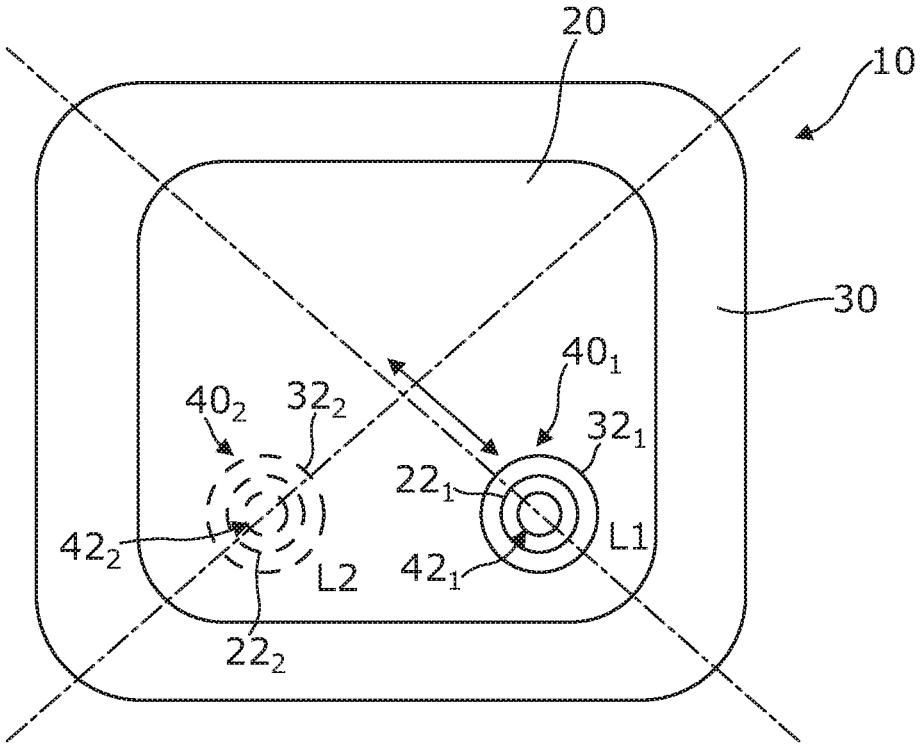
FIG. 5 shows another example of the subject matter described herein.

FIG. 5 illustrates a view of an example of an antenna system 10 as previously described that illustrates a location $L_n$ of the feed $\mathbf{40}_n$ relative to the antenna radiator 20. In this example, the feed $\mathbf{40}_n$ comprises the feed element $\mathbf{42}_n$, the first conductive element $\mathbf{22}_n$ and, if present, the second conductive element $\mathbf{32}_n$. The feed $\mathbf{40}_n$ is positioned off center with respect to the antenna radiator 20 Closer to an edge of the antenna radiator 20 than a center of the antenna radiator 20. In this example, the feed $\mathbf{40}_n$ is positioned along a diagonal of a rectangular or square patch antenna radiator towards a corner of the antenna radiator 20.

In some, but not necessarily all examples, there may be an additional, or further feed $\mathbf{40}_m$.

Thus in some examples, the antenna system 10 can comprise a ground plane 30; a substantially planar antenna radiator 20 separated from and overlapping the ground plane 30; a first conductive element $\mathbf{22}_1$ extending, at a first location L1, the antenna radiator 20 towards the ground plane 30; a feed element $\mathbf{42}_1$ configured to provide a radio frequency feed $\mathbf{40}_1$, at the first location L1, for the antenna radiator 20, wherein the feed element $\mathbf{42}_1$ is spatially separated from the first conductive element $\mathbf{22}_1$ and the antenna radiator 20;

a further first conductive element $\mathbf{22}_2$ extending, at a second location L2, the antenna radiator 20 towards the ground plane 30; a further feed element 422 configured to provide a further radio frequency feed $\mathbf{40}_2$, at the second location L2, for the antenna radiator 20, wherein the further feed element $\mathbf{42}_2$ is spatially separated from the further first conductive element $\mathbf{22}_2$ and the antenna radiator 20.

In the example illustrated there is additionally a second conductive element $\mathbf{32}_1$ extending, at the first location L1, the ground plane 30 towards the antenna radiator 20, wherein the second conductive element $\mathbf{32}_1$ is spatially separated from the first conductive element $\mathbf{22}_1$.

In the example illustrated there is additionally a second conductive element $\mathbf{32}_2$ extending, at the second location L2, the ground plane 30 towards the antenna radiator 20, wherein the second conductive element $\mathbf{32}_2$ is spatially separated from the first conductive element $\mathbf{22}_2$.

In this example, the first conductive element $\mathbf{22}_1$, the feed element $\mathbf{42}_1$ and, if present, the second conductive element $\mathbf{32}_1$ provide a first narrowband resonant frequency feed $\mathbf{40}_1$. The further first conductive element $\mathbf{22}_2$ and the further feed element $\mathbf{42}_2$ and, if present, the further second conductive element $\mathbf{32}_2$ provide a further second narrowband resonance frequency feed $\mathbf{40}_2$.

In some examples, the first narrowband resonant frequency feed $\mathbf{40}_1$ and the second narrowband resonant frequency feed $\mathbf{40}_2$ are configured to have different narrowband resonant frequencies, for example, as described above.

In some examples, the first narrowband resonant frequency feed $\mathbf{40}_1$ and the second narrowband resonant frequency feed $\mathbf{40}_2$ are configured to have the same resonant frequency but are located to have orthogonal polarization.

Figure 6:
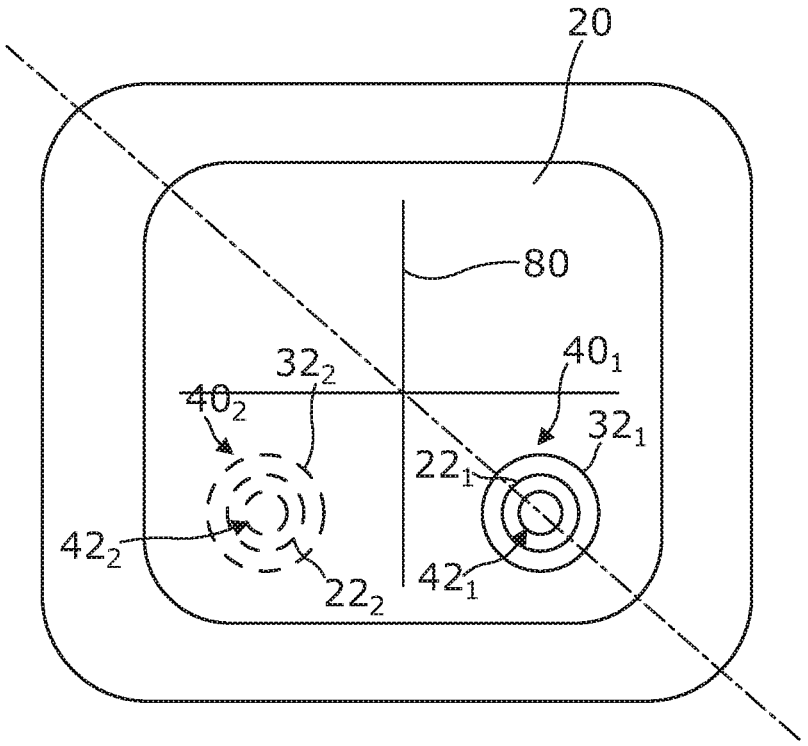
FIG. 6 shows another example of the subject matter described herein.
Figure 7:
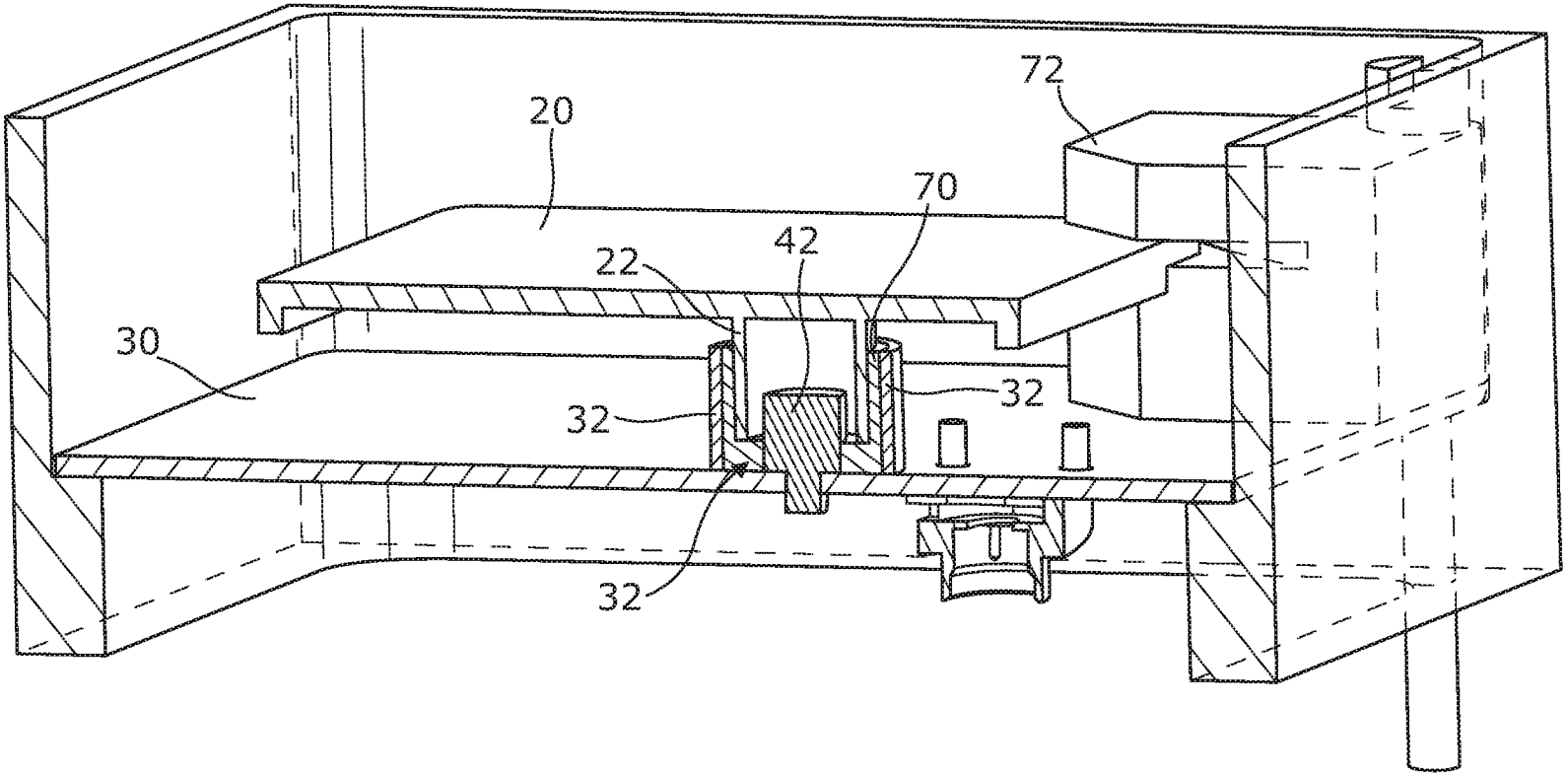
FIG. 7 shows another example of the subject matter described herein.

FIG. 6 illustrates an example of the antenna system 10 illustrated in FIG. 5 where a wall 80 is used to physically separate the first narrowband resonant frequency feed $\mathbf{40}_1$ and the second narrowband resonant frequency feed $\mathbf{40}_2$ FIG. 7 illustrates an example of previously described antenna systems 10. This example is similar to the example illustrated in FIGS. 3A, 3B, 3C and 3D. The description of those figures is also relevant to this figure. In this example, there is a dielectric material 70 placed between the cylindrical first conductive element 22 and the cylindrical second conductive element 32. This dielectric material 70 can be used to control a capacitance between the first conductive element 22 and the second conductive element 32 and can also be used to provide some physical support for the antenna radiator 20.

Optionally, as illustrated in this figure, there may also be provided a dielectric mount 72 that is used to physically support the antenna radiator 20. In this example, the dielectric mount 72 comprises a notch into which a portion of the antenna radiator 20 is inserted.

Figure 8A:
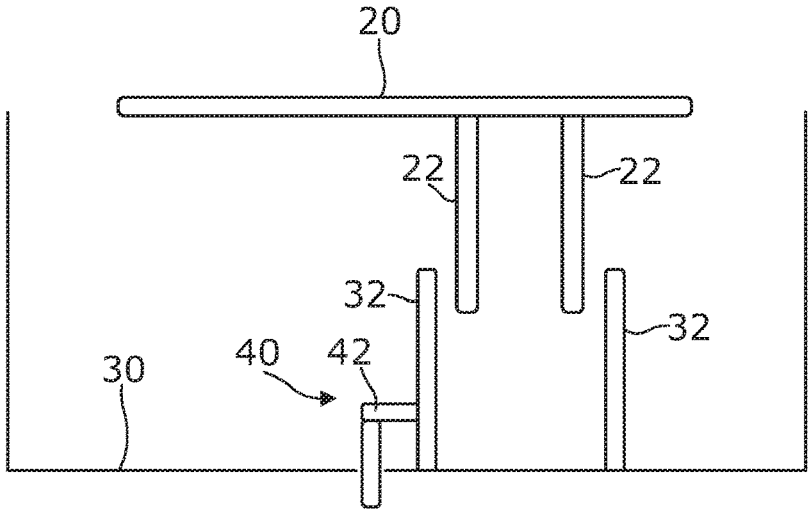
FIG. 8A shows another example of the subject matter described herein.
Figure 8B:
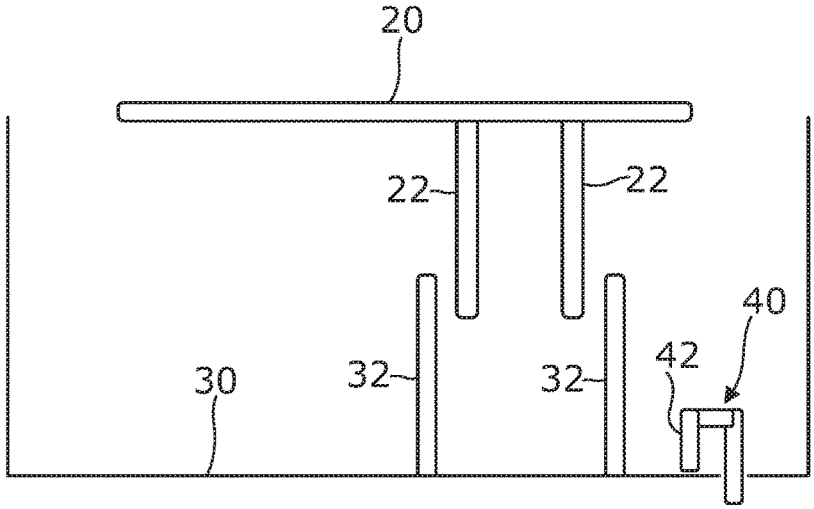
FIG. 8B shows another example of the subject matter described herein.

FIGS. 8A and 8B illustrate that it is possible to have different positions and arrangements for the feed element 42. In the examples of FIGS. 8A and 8B the feed element 42 is closest to the exterior cylindrical second conductive element 32 rather than the interior cylindrical first conductive element 22. In the example of FIG. 8A the feed element 42 is galvanically connected to the second conductive element 32. In the example of FIG. 8B, the feed element 42 is capacitively coupled to the second conductive element 32.

Figure 9:
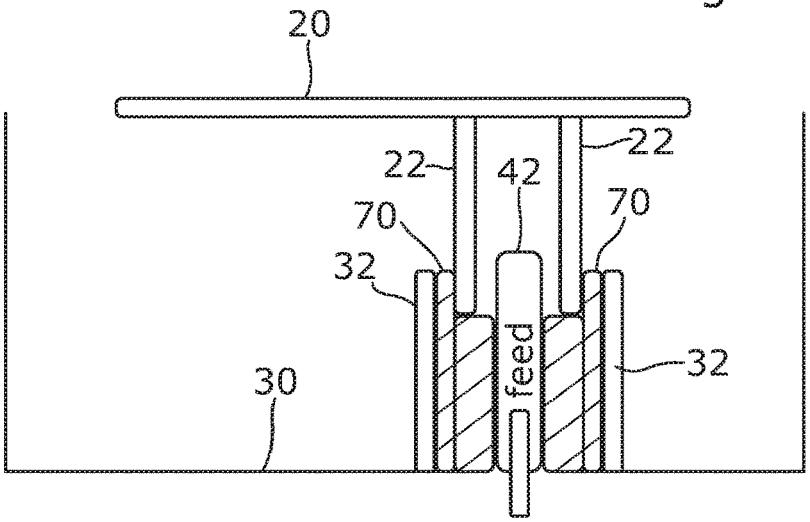
FIG. 9 shows another example of the subject matter described herein.

FIG. 9 illustrates an example in which dielectric material 70 is placed within the cylindrical second conductive element 70 and surrounds the feed element 42. The dielectric material 70 provides a physical support for the antenna radiator 20.

In the example illustrated, dielectric material 70 fills the void between the feed element 42 and the second conductive element 32. In this example, but not necessarily all examples, the dielectric material 70 fills the void between the first conductive element 22 and the second conductive element 32. In other examples, dielectric material 70 can additionally, or alternatively, fill the void between the feed element 42 and the first conductive element 22 or the void within the first conductive element 22.

Dielectric material 70 can also be used in other examples, for example FIG. 8A or 8B. In these examples, dielectric material (not illustrated) can be placed between the outer conductive element 32 and the feed element 42. Thus the feed element 42 could be manufactured as part of the conductive element 32 (and optionally also with the ground plane 30). These parts could, for example, be manufactured using Molded Interconnect Device (MID) techniques or Laser Direct Structuring (LDS), and other known molding and/or lasering manufacturing technologies.

The dielectric 70 can serve two purposes-mechanical support and controlling the electrical resonant properties of the feed element 42 and/or the conductive elements 22, 32.

Figure 10:
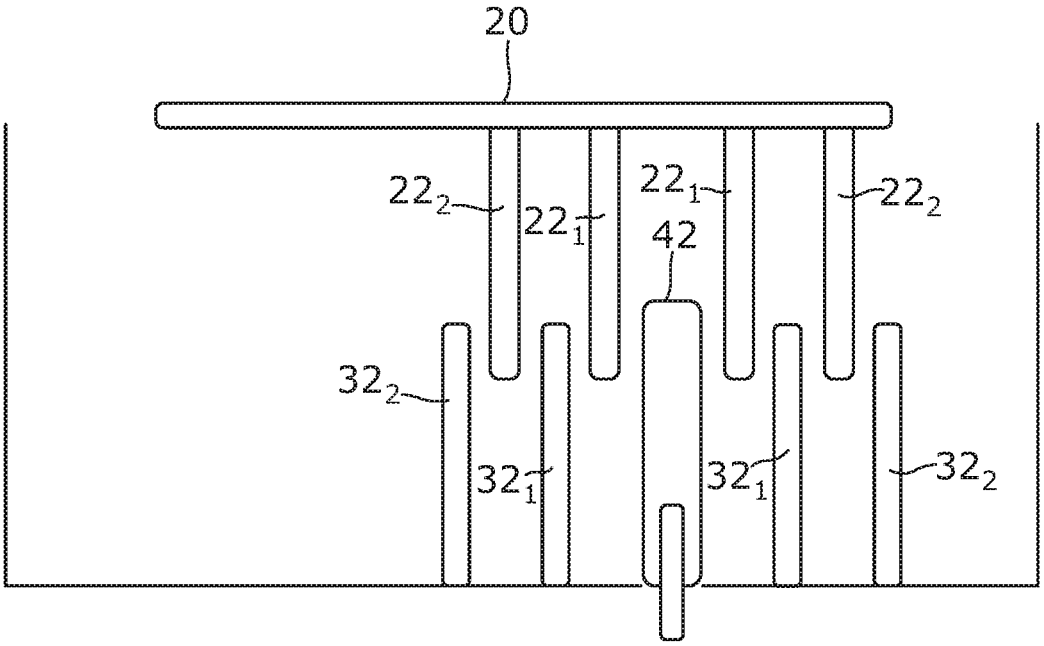
FIG. 10 shows another example of the subject matter described herein.

FIG. 10 illustrates that although in the previous examples a single first conductive element 22 is used and a single second conductive element 32 is used it is possible to use additional conductive elements. In this example, the feed element 42 partially extends within a smaller diameter cylindrical first conductive element $\mathbf{22}_1$, the smaller diameter cylindrical first conductive element $\mathbf{22}_1$ extends partially within a smaller diameter second cylindrical conductive element $\mathbf{32}_1$, the smaller diameter cylindrical second conductive element $\mathbf{32}_1$ extends partially within a larger diameter cylindrical first conductive element $\mathbf{22}_2$, and the larger diameter cylindrical first conductive element $\mathbf{22}_2$ extends partially within a larger diameter cylindrical second conductive element $\mathbf{32}_2$. In this example the smaller diameter cylindrical first conductive element $\mathbf{22}_1$ and the larger diameter cylindrical first conductive element $\mathbf{22}_2$ both extend the antenna radiator 20 towards the ground plane 30 and in addition, are coaxial with an elongate axis of the feed element 42. In this example the smaller diameter cylindrical second conductive element $\mathbf{32}_1$ and the larger diameter cylindrical second conductive element $\mathbf{32}_2$ both extend the ground plane 30 towards the antenna radiator 20 and in addition, are coaxial with an elongate axis of the feed element 42.

The features described above for the first conductive element 22 and the second conductive element 32 are also relevant to the smaller diameter cylindrical first conductive element $\mathbf{22}_1$ and the smaller diameter second cylindrical conductive element $\mathbf{32}_1$.

The features described above for the first conductive element 22 and the second conductive element 32 are also relevant to the larger diameter cylindrical first conductive element $\mathbf{22}_2$ and the larger diameter second cylindrical conductive element $\mathbf{32}_2$.

Figure 11:
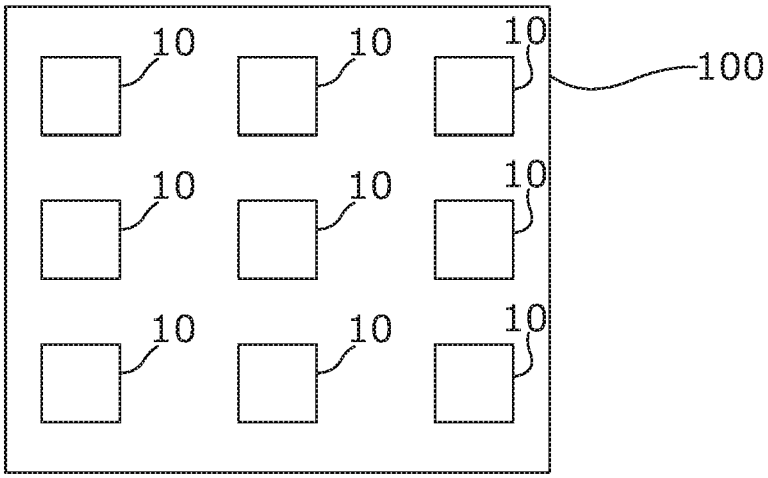
FIG. 11 shows another example of the subject matter described herein.

FIG. 11 illustrates an example of a network access node 100 comprising one or more antenna systems 10 as previously described. The network access node 100 can for example be a radio access network (RAN) node, for example a base transceiver station.

The network access node 100 can for example be a user equipment node or a portable electronic device.

The network access node 100 can, for example, be configured to transmit (but not receive), receive (but not transmit) or both transmit and receive.

Having additional filtering within the antenna feed 40, as described above, can save space and components.

The radio access technology can, for example, be 5G New Radio and/or 4G Long Term Evolution.

The radio access technology can, for example, operate in the sub 6 GHz range or in the mm-wavelength frequency spectrum.

The network access node 100 can for example comprise an antenna system 10 or a multiple antenna array formed from the multiple antenna systems 10. The narrowband radio frequency fed antenna systems 10 are particularly useful as the network access node 100 does not necessarily need to comprise large high-quality filters in addition to the antenna systems 10.

It is expected that this arrangement will be particularly useful in multiple input multiple output (MIMO) systems (including Massive MIMO or mMIMO) such as those that will be used in the 5G telecommunications system.

Where a structural feature has been described, it may be replaced by means for performing one or more of the functions of the structural feature whether that function or those functions are explicitly or implicitly described.

The term 'narrowband' implies a narrow operational bandwidth. The term 'broadband' implies a broad operational bandwidth. An operational resonant mode (operational bandwidth) is a frequency range over which an antenna can efficiently operate. An operational resonant mode (operational bandwidth) may be defined as where the return loss S11 of the antenna 20 is less than a (negative) operational threshold T.

The S11 of the antenna varies for different systems, mostly depending on the frequency range and the power. For example, 10-14 dB return loss is acceptable-according to some specifications for a base station.

Narrowband could for example be 100-200 MHz at 3.5 GHz. Wideband could be more than double, e.g. 400 MHz.

The instantaneous bandwidth for a 5G antenna is 100 MHz, the range of operation is currently 200 MHz (3.5 GHz-3.7 GHz) and can at any moment extend to 400 MHz (e.g. 3.3 GHz-3.7 GHz). So 100 MHz can, in this example, be considered narrowband and the 400 MHz can be considered wideband. For other antenna applications these number vary.

The antenna radiator 20 and the feed 40 may be configured to operate in a plurality of operational resonant frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting—handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultrahigh frequency (RFID UHF) (433 MHz, 865-956 MHz, 2450 MHz), frequency allocations for 5G may include e.g. 700 MHz, 3.6-3.8 GHz, 24.25-27.5 GHz, 31.8-33.4 GHz, 37.45-43.5, 66-71 GHz, mmWave, and >24 GHz).

In some examples the antenna radiator may only partially overlap the ground plane 30.

In some examples there is a gap in the ground plane 30 for the feed element 42 to extend through without contacting the ground plane 30. A circular cut-out can be used to create an aperture 60 for the feed element 42 to extend through.

The above described examples find application as enabling components of: automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. An antenna system comprising:

a ground plane;

an antenna radiator separated from and overlapping the ground plane;

a plurality of first conductive elements comprising a smaller diameter first conductive element and a larger diameter first conductive element at least partially surrounding the smaller diameter first conductive element;

a plurality of second conductive elements comprising a smaller diameter second conductive element and a larger diameter second conductive element at least partially surrounding the smaller diameter first conductive element; and at least one feed element configured to provide a radio-frequency feed for the antenna radiator, wherein a respective feed element of the at least one feed element is spatially separated from the plurality of first conductive elements, the plurality of second conductive elements and the antenna radiator, and wherein the plurality of first conductive elements extend the antenna radiator towards the ground plane and the plurality of second conductive elements extend the ground plane toward the antenna radiator.

2. An antenna system as claimed in claim 1, wherein the respective feed element extends substantially parallel to the plurality of first conductive elements.

3. An antenna system as claimed in claim 1, wherein the plurality of second conductive elements are spatially separated from the plurality of first conductive elements.

4. An antenna system as claimed in claim 1, wherein the respective feed element extends towards the antenna radiator in a direction substantially parallel to a direction in which the plurality of first conductive elements extend the antenna radiator and substantially parallel to a direction in which the plurality of second conductive elements extend the ground plane.

5. An antenna system as claimed in claim 1, wherein the plurality of first conductive elements circumscribe a first portion of a length of the respective feed element and the plurality of second conductive element circumscribe a different, second portion of the length of the respective feed element.

6. An antenna system as claimed in claim 1, wherein the plurality of first conductive elements extend towards the ground plane and have an axis of rotational symmetry that extends towards the ground plane, the plurality of second conductive elements extend towards the respective antenna radiator and have an axis of rotational symmetry that extends towards the respective antenna radiator, and the respective feed element extends towards the respective antenna radiator along an axis of rotational symmetry that extends towards the respective antenna radiator, and wherein the axes of the plurality of first conductive elements, the plurality of second conductive elements, and the respective feed element are coaxial.

7. An antenna system as claimed in claim 1, wherein each of the plurality of first conductive elements is shaped substantially as a hollow cylinder having a respective diameter, and wherein each of the plurality of second conductive elements is shaped substantially as a hollow cylinder having a respective diameter, different than the respective diameters of each of the plurality of first conductive elements.

8. An antenna system as claimed in claim 1, wherein the smaller diameter first conductive element is closer to the respective feed element than the smaller diameter second conductive element.

9. An antenna system as claimed in claim 1, wherein the respective feed element is an open-ended feed configured to contactlessly feed the antenna radiator.

10. An antenna system as claimed in claim 1, wherein the smaller diameter first conductive element is positioned closer to an edge of the antenna radiator than a center of the antenna radiator.

11. An antenna system as claimed in claim 1, wherein the at least one feed element partially extends within the smaller diameter first conductive element, the smaller diameter first conductive element partially extends within the smaller diameter second conductive element, the smaller diameter second conductive element partially extends within the larger diameter first conductive element, and the larger diameter first conductive element partially extends within the larger diameter second conductive element.

12. An antenna system as claimed in claim 1, wherein the smaller diameter second conductive element and the larger diameter second conductive element are coaxial with an elongate axis of the at least one feed element.

13. A network access node or portable electronic device comprising one or more antenna systems, wherein each antenna system comprises:

a ground plane;

an antenna radiator separated from and overlapping the ground plane;

at least one first conductive element having a first diameter and extending the antenna radiator towards the ground plane;

at least one second conductive element having a second diameter and extending the ground plane toward the antenna radiator; and at least one feed element configured to provide a radio-frequency feed for the antenna radiator, wherein a respective feed element of the at least one feed element is spatially separated from a respective first conductive element of the at least one first conductive element and the antenna radiator, wherein the at least one feed element is positioned outside of the at least one second conductive element and is capacitively coupled to the at least one second conductive element.

14. A network access node or portable electronic device comprising one or more antenna systems as claimed in claim 13, wherein the feed element is closer to an exterior of the second conductive element than an interior of the first conductive element.

15. A narrowband resonant frequency feed system for an antenna radiator comprising:

a ground plane;

a feed element extending in a first direction from the ground plane to provide a radio frequency feed for the antenna radiator;

a plurality of first conductive elements comprising a smaller diameter first conductive element and a larger diameter first conductive element extending from the antenna radiator; and a plurality of second conductive elements comprising a smaller diameter second conductive element and a larger diameter second conductive element extending in the first direction from the ground plane and at least partially circumscribing the feed element; wherein the feed element is spatially separated from the plurality of second conductive elements and the plurality of second conductive elements are galvanically connected to the ground plane.

16. A narrowband resonant frequency feed system as claimed in claim 15, wherein the feed element extends substantially parallel to the plurality of second conductive elements.

17. A narrowband resonant frequency feed system as claimed in claim 15, wherein the plurality of first conductive elements extend toward the ground plane and have an axis of rotational symmetry that extends towards the ground plane and the feed element extends towards the antenna radiator along an axis of rotational symmetry that extends towards the antenna radiator, wherein the plurality of first and second conductive elements and the feed element are substantially coaxial.

18. A narrowband resonant frequency feed system as claimed in claim 15, wherein each of the plurality of first conductive elements and each of the plurality of second conductive elements is shaped substantially as a hollow cylinder.

19. A narrowband resonant frequency feed system as claimed in claim 15, wherein the feed element is an open-ended feed configured to contactlessly feed the antenna radiator, and wherein the plurality of first conductive elements circumscribe a first portion of a length of the respective feed element and the plurality of second conductive element circumscribe a different, second portion of the length of the respective feed element.

20. A narrowband resonant frequency feed system as claimed in claim 15, wherein the smaller diameter first conductive element is positioned closer to an edge of the antenna radiator than a center of the antenna radiator.

* * * * *